US011614298B2

(12) United States Patent
Bray

(10) Patent No.: US 11,614,298 B2
(45) Date of Patent: Mar. 28, 2023

(54) FIREARM SUPPRESSOR

(71) Applicant: Polaris Capital LLC, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/155,056

(22) Filed: Jan. 21, 2021

(65) Prior Publication Data

US 2021/0389072 A1 Dec. 16, 2021

Related U.S. Application Data

(60) Provisional application No. 62/964,091, filed on Jan. 21, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34
USPC ..... 89/14.4; 181/223
See application file for complete search history.

(56) References Cited

U.S. PATENT DOCUMENTS

| | | | |
|---|---|---|---|
| 748,157 | A | 12/1903 | Bouton |
| 854,778 | A | 5/1907 | Thomson |
| 1,087,397 | A | 2/1914 | Persson |
| 1,140,578 | A | 5/1915 | Coulombe |
| 1,770,471 | A | 7/1930 | Hatcher |
| 1,901,138 | A | 3/1933 | Barnes |
| 1,939,700 | A | 12/1933 | Hofstetter |
| 2,112,831 | A | 4/1938 | Cutts, Jr. |
| 2,359,365 | A | 10/1944 | Morris |
| 2,451,514 | A | 10/1948 | Sieg |
| 2,514,996 | A | 7/1950 | Faust, Jr. |
| 2,798,569 | A | 7/1957 | Fischer, Jr. |
| 2,899,866 | A | 8/1959 | Clark et al. |
| 3,202,056 | A | 8/1965 | Kurt |
| 3,399,597 | A | 9/1968 | Perrine |

(Continued)

OTHER PUBLICATIONS

PCT/US2021/023166 Notification of Transmittal of the International Search Report and the Written Opinion of the International Searching Authority, or the Declaration, PCT, dated Dec. 2, 2021, pp. 1-11.

(Continued)

*Primary Examiner* — Jonathan C Weber
(74) *Attorney, Agent, or Firm* — Kunzler Bean & Adamson

(57) ABSTRACT

A firearm suppressor is disclosed. In certain examples, the firearm suppressor includes an elongated core comprising at least one series of ports extending radially from a bore to an exterior surface of the core, where the at least one series of ports is disposed linearly along a longitudinal axis of the core, and where the elongated core comprises at least one annular channel formed in the exterior surface of the core and disposed between adjacent pairs of the ports. The firearm suppressor may also include a baffle sleeve disposed around the core, the baffle sleeve having at least one uninterrupted fluid pathway extending along the exterior surface of the baffle sleeve and formed by interdigitated baffle ridges, and an outer tube disposed around the baffle sleeve.

20 Claims, 13 Drawing Sheets

(56) References Cited

U.S. PATENT DOCUMENTS

| | | | | |
|---|---|---|---|---|
| 3,500,955 | A | 3/1970 | Werbell | |
| 3,667,570 | A | 6/1972 | WerBell, III | |
| 3,786,895 | A | 1/1974 | Perrine | |
| 3,913,703 | A | 10/1975 | Parker | |
| 4,055,231 | A | 10/1977 | Martinez | |
| 4,576,083 | A | 3/1986 | Seberger, Jr. | |
| 4,869,151 | A | 9/1989 | Chahin | |
| 5,029,512 | A | 7/1991 | Latka | |
| 5,036,747 | A | 8/1991 | Mcclain, III | |
| 5,092,223 | A | 3/1992 | Hudson | |
| 5,136,923 | A | 8/1992 | Walsh, Jr. | |
| 5,367,940 | A | 11/1994 | Taylor | |
| 5,631,438 | A | 5/1997 | Martel | |
| 5,831,223 | A | 11/1998 | Kesselring | |
| 6,516,698 | B1 | 2/2003 | Poff, Jr. | |
| 6,722,254 | B1 | 4/2004 | Davies | |
| 7,832,323 | B1 | 11/2010 | Davies | |
| 7,987,944 | B1 | 8/2011 | Brittingham et al. | |
| D666,687 | S | 9/2012 | Nierenberg | |
| 8,286,750 | B1 | 10/2012 | Oliver | |
| 8,424,635 | B1 | 4/2013 | Klawunn | |
| 8,464,625 | B2 | 6/2013 | Polovnev et al. | |
| 8,490,535 | B1 | 7/2013 | Moore et al. | |
| D694,355 | S | 11/2013 | Hormann | |
| 8,844,422 | B1 | 9/2014 | Klett | |
| 8,875,612 | B1 | 11/2014 | Klett et al. | |
| 9,080,829 | B1 | 7/2015 | Cellini | |
| 9,347,727 | B1 | 5/2016 | Cler | |
| 9,417,022 | B2 | 8/2016 | Sherrill | |
| 9,423,198 | B1 | 8/2016 | Oliver | |
| 9,441,900 | B1 | 9/2016 | Parrish | |
| 9,482,484 | B2 | 11/2016 | Barney | |
| 9,562,734 | B2 | 2/2017 | Wilson | |
| 9,599,421 | B1 | 3/2017 | Dean | |
| 9,677,839 | B1 | 6/2017 | Phoenix | |
| 9,746,267 | B2 | 8/2017 | Smith | |
| 9,851,166 | B2 | 12/2017 | Petersen | |
| 9,933,224 | B2 | 4/2018 | Dorne et al. | |
| 10,054,384 | B1 | 8/2018 | Marfione | |
| 10,060,695 | B2 * | 8/2018 | Slack | F41A 21/30 |
| 10,113,826 | B2 | 10/2018 | Bray | |
| 10,234,230 | B1 | 3/2019 | Oglesby | |
| 10,488,137 | B1 * | 11/2019 | Dean | F41A 21/30 |
| 11,092,398 | B2 * | 8/2021 | Slack | F41A 21/34 |
| 2004/0123729 | A1 | 7/2004 | Meyers | |
| 2006/0060076 | A1 | 3/2006 | Dueck et al. | |
| 2010/0275493 | A1 | 11/2010 | Polovnev et al. | |
| 2011/0271575 | A1 | 11/2011 | Overbeek et al. | |
| 2012/0048100 | A1 | 3/2012 | Davies | |
| 2012/0228052 | A1 | 9/2012 | Findlay | |
| 2012/0272818 | A1 | 11/2012 | Dueck et al. | |
| 2013/0227871 | A1 | 9/2013 | Stone | |
| 2013/0233162 | A1 | 9/2013 | Schneider | |
| 2013/0263490 | A1 | 10/2013 | Oliver | |
| 2013/0340313 | A1 | 12/2013 | Myers et al. | |
| 2014/0224574 | A1 | 8/2014 | Latka | |
| 2014/0299405 | A1 | 10/2014 | Miller et al. | |
| 2014/0353076 | A1 | 12/2014 | Bethlenfalvy | |
| 2015/0001001 | A1 | 1/2015 | Wilson | |
| 2015/0184960 | A1 | 7/2015 | Monveldt | |
| 2015/0192379 | A1 | 7/2015 | Larson, Jr. | |
| 2015/0260473 | A1 | 9/2015 | Barney | |
| 2015/0308772 | A1 | 10/2015 | James | |
| 2015/0308774 | A1 | 10/2015 | Sherrill | |
| 2015/0308778 | A1 | 10/2015 | Vossler | |
| 2015/0338183 | A1 | 11/2015 | Salvador | |
| 2016/0003570 | A1 | 1/2016 | Tonkin | |
| 2016/0018179 | A1 | 1/2016 | Morris et al. | |
| 2016/0084602 | A1 | 3/2016 | Smith | |
| 2016/0091269 | A1 | 3/2016 | Miller, III | |
| 2016/0123689 | A1 | 5/2016 | Maeda | |
| 2016/0153734 | A1 | 6/2016 | Oliver | |
| 2016/0161203 | A1 | 6/2016 | Wilson | |
| 2016/0209151 | A1 | 7/2016 | Smith | |
| 2016/0209153 | A1 | 7/2016 | Dueck et al. | |
| 2017/0023326 | A1 | 1/2017 | Wilson | |
| 2017/0030672 | A1 | 2/2017 | Larue | |
| 2017/0067711 | A1 * | 3/2017 | Slack | F41A 21/30 |
| 2017/0191782 | A1 | 7/2017 | Bray | |
| 2017/0199002 | A1 | 7/2017 | Hwang et al. | |
| 2017/0205174 | A1 | 7/2017 | Petersen | |
| 2017/0205175 | A1 | 7/2017 | Garst et al. | |
| 2017/0321985 | A1 * | 11/2017 | Bray | F41A 21/34 |
| 2018/0038663 | A1 | 2/2018 | Larue | |
| 2018/0135932 | A1 | 5/2018 | Tomczak | |
| 2018/0356173 | A1 | 8/2018 | Dome et al. | |
| 2018/0252489 | A1 | 9/2018 | Parker | |
| 2018/0340750 | A1 | 11/2018 | Mooty | |
| 2018/0347931 | A1 | 12/2018 | Schoppman | |
| 2018/0347932 | A1 * | 12/2018 | Bray | F41A 21/30 |
| 2019/0041155 | A1 | 2/2019 | Deras | |
| 2019/0072353 | A1 * | 3/2019 | Slack | F41A 21/30 |
| 2020/0263947 | A1 | 8/2020 | Calderwood et al. | |
| 2020/0284541 | A1 * | 9/2020 | Poling | F41A 21/30 |
| 2021/0041200 | A1 | 2/2021 | Kras et al. | |
| 2021/0102774 | A1 | 4/2021 | Vanhatalo et al. | |
| 2021/0180902 | A1 * | 6/2021 | Bray | F41A 21/30 |
| 2021/0239419 | A1 | 8/2021 | Lo | |
| 2021/0381793 | A1 * | 12/2021 | Slack | F41A 21/34 |

OTHER PUBLICATIONS

"Office Action", United States Patent and Trademark Office, dated Nov. 3, 2021, pp. 1-17.

* cited by examiner

FIREARM SUPPRESSOR

CROSS-REFERENCES TO RELATED APPLICATIONS

This application claims the benefit of, and claims priority to, U.S. Provisional Patent Application No. 62/964,091 entitled "FIREARM SUPPRESSOR" and filed on Jan. 21, 2020 for Ernest R. Bray, which is incorporated herein by reference.

FIELD

This application relates generally to firearms. In particular, this application relates to firearm suppressors.

BACKGROUND

Suppressor design has, for over 100 years, included the basic structure of a series of baffles and chambers which trap expanding gasses as they exit a muzzle. Though there have been many variations on this core design concept, virtually every design has followed this basic design. However, this basic design is flawed because it traps the pressure in the initial chamber and significant pressure is generated on the first baffle, commonly called the "blast baffle". This pressure and heat buildup in that first chamber creates several negative effects that include back pressure into the barrel. This back pressure often causes the firearm to malfunction from added carbon and fouling from the gasses. Additionally, over gassing the system and increasing the cyclic rate creates additional stresses on the components that lead to mechanical failures. Another negative effect of excessive backpressure is that gasses and debris are blown back into the operator's face.

The other shortcomings of the basic design are that the gasses must exit out of the small holes either back into the barrel, or forward against the base of the bullet, which can cause turbulence and accuracy issues.

Also, most basic designs do not create optimum gas expansion, diffusion and cooling, because the designs provide poor heat transfer "heat sink" capabilities. Accordingly, gas expansion is limited, and gas pressures are maintained until the bullet exits the suppressor, at which point the hot gasses finally are allowed to exit the small-bore hole at relatively high pressure, velocity and heat. Pressure, velocity, and heat are the main contributors to the sound signature.

One other area that adds to the overall sound signature of these designs is that the bullets may push a supersonic cone of air ahead of the bullet and as the bullet passes through each chamber a sonic boom is created in the ambient air within each chamber and again as the bullets exit the suppressors. Another design failure of the basic design is that the ambient air contained in the chambers is ignited and results in a large flash out the end of the suppressor. Because this flash may attract the attention of an armed enemy and notify the enemy of the operator's location, this flash is known to members of the armed forces as the "bloom of death".

SUMMARY

A firearm suppressor is disclosed. In certain examples, the firearm suppressor includes an elongated core comprising at least one series of ports extending radially from a bore to an exterior surface of the core, where the at least one series of ports is disposed linearly along a longitudinal axis of the core, and where the elongated core comprises at least one annular channel formed in the exterior surface of the core and disposed between adjacent pairs of the ports. The firearm suppressor may also include a baffle sleeve disposed around the core, the baffle sleeve having at least one uninterrupted fluid pathway extending along the exterior surface of the baffle sleeve and formed by interdigitated baffle ridges, and an outer tube disposed around the baffle sleeve.

In certain examples, the at least one series of ports extending radially from the bore comprises two series of ports extending radially from the bore, and where each port of the at least one series of ports extends outward radially from the bore at a non-orthogonal angle. In certain examples, each port of the at least one series of ports is angled toward a muzzle end of the elongated core. The non-orthogonal angle may be in the range of between about 5 and 80 degrees.

In certain examples, the baffle sleeve further comprises a plurality of port openings that fluidly couple an interior surface of the baffle sleeve with an exterior surface of the baffle sleeve, and where at least one of the plurality of port openings is positioned such that the at least one of the plurality of port openings is aligned with at least one port of the at least one series of ports. In certain examples, the elongated core comprises a stem extending outward from an exhaust block, and the stem is configured to receive a baffle sleeve retainer and a plurality of forward baffles. In certain examples, the baffle sleeve retainer comprises a plurality of annularly arranged passages.

In certain examples, each of the plurality of forward baffles comprises at least one vane configured to direct exhaust gasses in either one of a clockwise direction or a counterclockwise direction. In certain examples, the firearm suppressor also includes a forward baffle retainer comprising a threaded outer surface configured to thread into an end of the outer tube, and an end cap configured to couple to the forward baffle retainer.

In certain examples, the end cap comprises at least one direction vane configured to rotationally direct exhaust gasses as the exhaust gasses leave the firearm suppressor. Each of the forward baffles comprises a key in an opening that is configured to engage an indexing slot in the stem to rotationally index each of the forward baffles with respect to the elongated core.

In certain examples, the elongated core further comprises a base having a diameter greater than the elongated core, where the base forms a platform for receiving the baffle sleeve and the outer tube.

Also included is a baffle sleeve having a plurality of uninterrupted fluid pathways formed on an exterior surface of the baffle sleeve and extending from a first end of the baffle sleeve to a second end of the baffle sleeve, where each of the plurality of uninterrupted fluid pathways is defined by a plurality of interdigitated baffle ridges, where the plurality of interdigitated baffle ridges of each of the plurality of uninterrupted fluid pathways defines a laterally serpentine pathway along a longitudinal axis.

BRIEF DESCRIPTION OF THE DRAWINGS

A more particular description of the examples briefly described above will be rendered by reference to specific examples that are illustrated in the appended drawings. Understanding that these drawings depict only some examples and are not therefore to be considered to be limiting of scope, the examples will be described and explained with additional specificity and detail through the use of the accompanying drawings, in which:

FIGS. 3*a* and 3*b* are diagrams illustrating another example of the muzzle signature management device in accordance with examples of the present disclosure;

DETAILED DESCRIPTION

The subject matter of the present application has been developed in response to the present state of the art, and in particular, in response to the problems and needs in the art that have not yet been fully solved by currently available firearm suppressors. Accordingly, the subject matter of the present application has been developed to provide a firearm suppressor that overcomes at least some shortcomings of the prior art.

As will be described in greater detail below, the suppressor incorporates a design that employs a symmetrical three-dimensional gas flow, for maximum gas expansion, cooling and diffusion. The result of the design is a continuous and steady state pressure release, instead of a pressure release when a bullet leaves the suppressor. Additionally, the suppressor design has minimal to no backpressure, multiple design features which eliminate flash, distribute heat evenly across the suppressor for lower thermal signature, and improved heat transfer and cooling. These features also lower thermal stresses and thermal stress related component failures.

Another benefit of the suppressor of the present disclosure is the ability to be drained of water in less than two seconds (typically, Special Forces units require an ability to be drained within 8 seconds). These and other features and benefits will be described in greater detail below.

Figure 1:
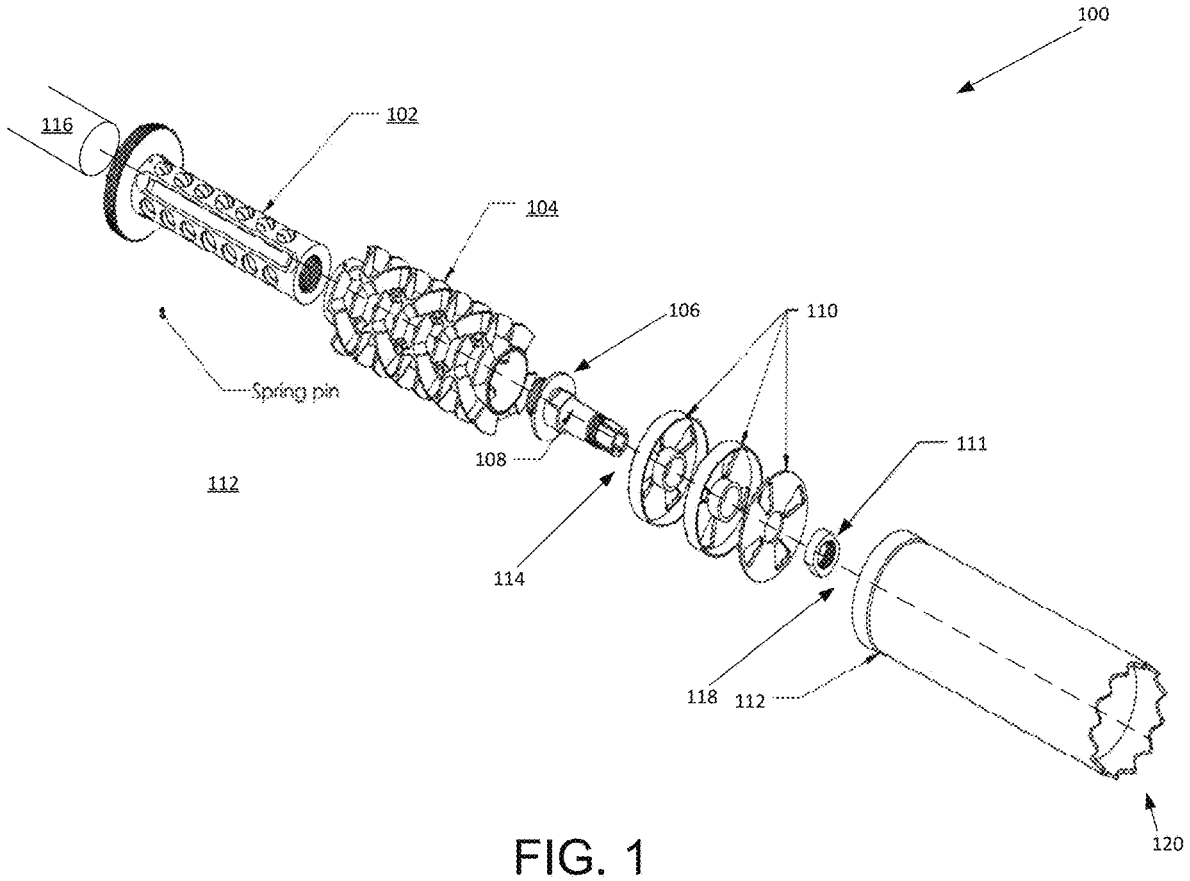
FIG. 1 is an exploded perspective view diagram illustrating one example of a firearm suppressor in accordance with examples of the present disclosure.

FIG. 1 is an exploded perspective view diagram illustrating one example of a firearm suppressor 100 in accordance with examples of the present disclosure. Although the below described examples describe the use of the suppressor 100 in use with a rifle, the components and methods described may be modified to accommodate different types of firearms, including but not limited to, pistols, shotguns, etc.

In the depicted example, the suppressor 100 is formed of multiple individual components that may be separately manufactured and assembled to form the suppressor 100. However, the suppressor 100 may alternatively be manufactured as a single unitary product. It is contemplated that as 3D printing techniques improve, the suppressor 100 may be manufactured by these 3D printing techniques. Generally, the suppressor 100 is formed of metals and/or metallic alloys. Different materials may be used for the different components, as it may be desirable for one component to absorb and diffuse heat, and thereby have a high coefficient of thermal conductivity, and another component to have a low coefficient of thermal conductivity.

As depicted, the suppressor 100 is formed with a core 102, a baffle sleeve 104, a baffle tube retainer 106, a spacer tube 108, one or more forward baffles 110, a retainer nut 111, and an outer tube 112. In one example, the tube retainer 106 and the spacer tube 108 are integral, alternatively, the tube retainer 106 and the spacer tube 108 are formed separately. The suppressor 100 has a longitudinal axis (depicted by line 114) that extends from a longitudinal axis of a firearm barrel 116, and depicts the path a bullet will travel from the barrel 116 towards the exit 118 of the suppressor 100. The suppressor 100 is formed with an inlet that engages the muzzle end of the barrel 116 to receive a bullet, or other high energy (i.e., high velocity) device, and an outlet 120 through which the bullet travels and for exhausting and dissipating muzzle blast, bullet shock waves, and other particulates.

Figure 2:
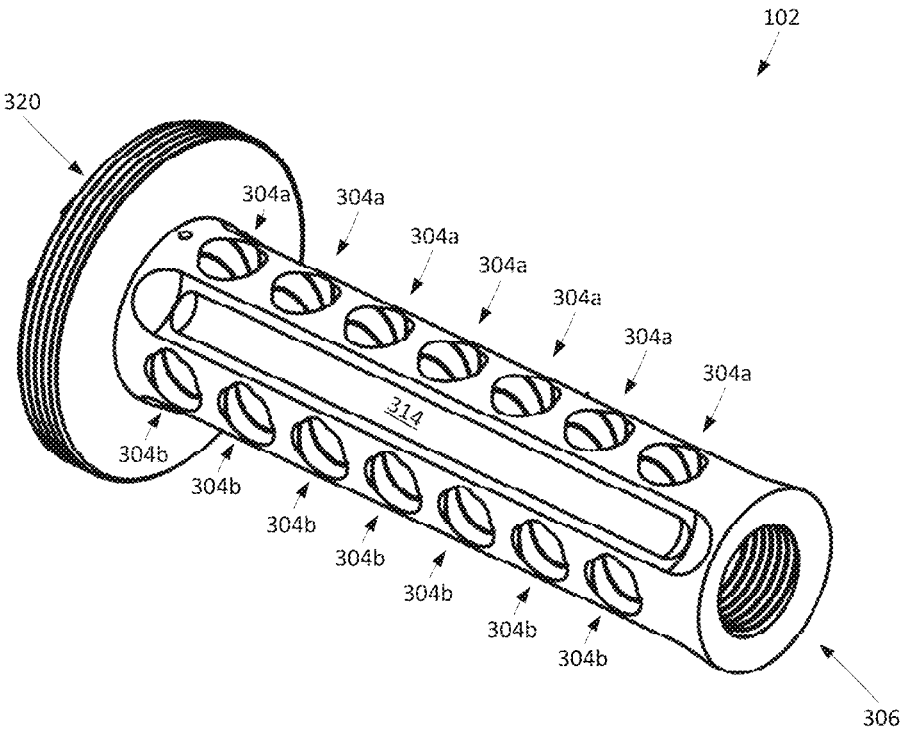
FIGS. 2, 3*a* and 3*b* illustrate various views of the core, according to examples of the subject disclosure.
Figure 3A:
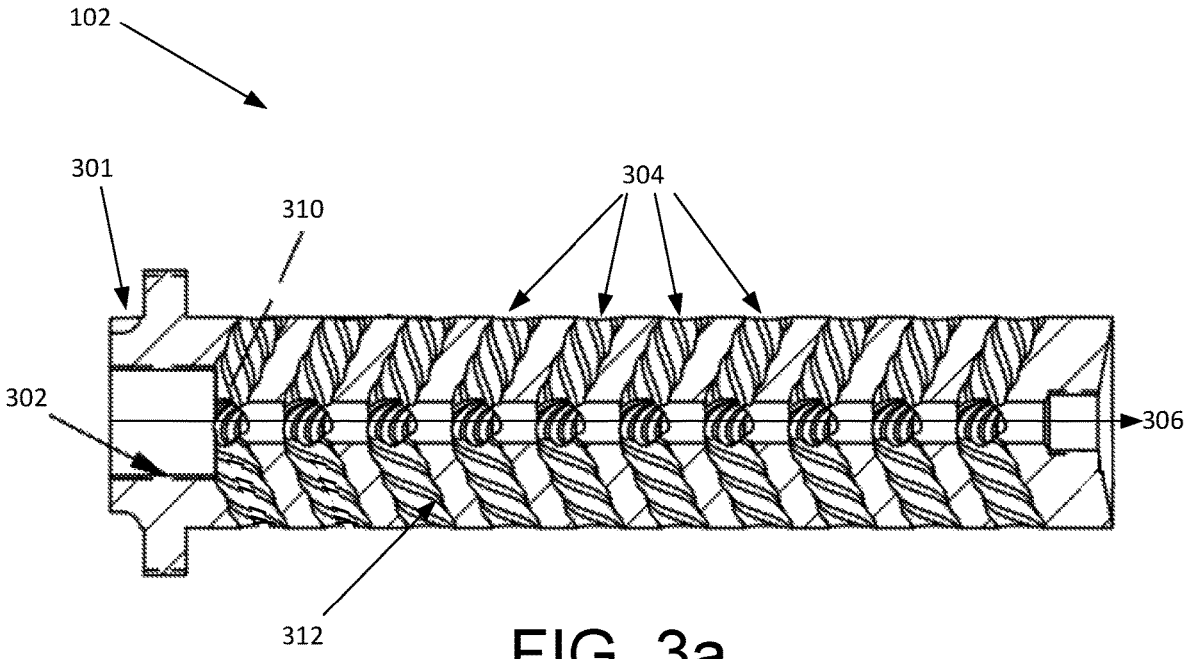
Figure 3B:
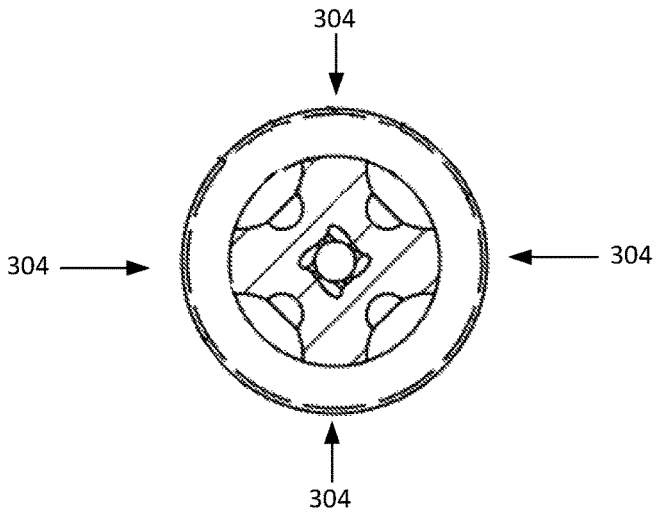

FIGS. 2, 3*a* and 3*b* collectively refer to the core 102, and will be discussed jointly. FIG. 2 is a perspective view diagram illustrating one example of the core 102 in accordance with examples of the disclosure. The core 102 is a single component that may be machined or cast from appropriate materials, including, but not limited to steel, stainless steel, titanium, Inconel and aluminum. In one example, the core 102 threads onto the muzzle of the firearm (i.e., the end of the barrel 116 of FIG. 1) with various types of standard or metric threads. Additionally, as depicted in FIG. 2, the opposite end of the core 102 may have internal threads for receiving a male threaded end of the spacer tube 108.

In one example, interrupted threads (not shown) may be utilized to implement a quick attachment method to attach the core 102 over a muzzle device such as a flash hider, muzzle brake, or muzzle signature management device. In another example, the core 102 may have flats 301 machined or otherwise formed on the muzzle-engaging end 302 to allow a wrench, or other tool, to apply torque to the suppressor 100 to attach it to the firearm.

The core 102 may have a series of ports 304 that extend radially outward from the bore 306. In the below description, a port is generally identified as "port 304," and may be individually identified as "port 304*a*," etc. Each port 304 forms a channel that fluidly couples an interior surface of the core 102 with an exterior surface. Stated differently, each port 304 creates an opening that extends from the exterior surface to the interior surface.

In the depicted example, the ports 304 are generally arranged in a longitudinal manner, or in other words, a series of ports 304*a*, 304*b* (see FIG. 2) are linearly aligned. In one example, each series 304*a*, 304*b* of linearly arranged ports is spaced 90 degrees from the neighboring series of ports. Stated differently, if one were to look down the bore along the longitudinal axis (see FIG. 1), the ports 304 would extend along the 12, 3, 6, and 9 o'clock positions as depicted in FIG. 3*b*. Other arrangements are contemplated, including, but not limited to more or less series of ports 304*a*, 304*b*, non-linearly arranged series (e.g., a series aligned with a path that extends helically around the exterior of the core 102), randomly positioned ports, etc.

Referring to FIG. 3*a*, which is a cross-sectional diagram of the core 102, the ports 304 may be angled forward (i.e., towards the muzzle end 120 of the suppressor) to create a forward moving air flow. In other words, the ports 304 extend outward from the bore at a non-orthogonal angle with respect to the bore. The angle, formed by lines 306 and 310 (which depict axis of the bore and the port, respectively), is in the range of between about 5 and 80 degrees. In another example, the angle is about 65 degrees. In other examples, the ports extend perpendicularly from the bore 306, or alternatively, the ports 304 may be angled rearward (i.e., towards the muzzle end of the rifle). As used herein, the phrase "muzzle end" refers to the opening through which a bullet exits a device.

In one example, each port 304 is formed having helical flutes 312 or grooves. Beneficially, the helical flutes 312 direct gasses away from the bore 306 and cause the gasses to form a vortex in each port 304. The act of forming the vortex functions to slow the gasses. The sonic pressure wave formed by a fired projectile is bled off ahead of the bullet through ports 304 between a current position of the projectile and the muzzle end of the suppressor 100, thereby reducing or eliminating a sonic boom from the projectile traveling through ambient air. The helical fluting 312 in the ports 304 slows the gasses, creates recoil mitigation through resistance against the port walls and fluting and also creates effective heat transfer by increasing exposed surface area of the core 102, thereby cooling the gasses. The helical flutes 312 also create a turbulent gas flow that serves to slow the exit gasses further.

The monolithic nature of the core 102, beneficially, has no initial blast baffle (as in most suppressors) and therefore eliminates issues with higher pressure cartridges, and virtually eliminates backpressure. As used herein, the term "monolithic" refers to the method of manufacture of the core 102, in that the core 102 is formed from a single block of material. Further, the monolithic core 102 provides greater strength, rigidity and no possibility of a baffle strike by the bullet/projectile caused by baffle misalignment. Baffle erosion is also eliminated.

In one example, the core 102 includes one or more expansion troughs 314 formed in an exterior surface of the core 102 (see FIG. 2). Each expansion trough 314, in one example, extends longitudinally along the exterior surface of the core 102. In another example, each expansion trough 314 is disposed between adjacent linear series (or stacks) of ports 304, as depicted. In such an arrangement, the core 102 is formed with four expansion troughs 314. Beneficially, the expansion troughs 314 serve to reduce weight and provide additional expansion areas for gasses while also increasing the exterior surface area of the core 102, which is useful for cooling the gasses.

In one example, the core 102 also includes a base 320 for receiving the outer tube 112 (or sleeve). The base 320, in one example, extends outward radially from the core 102 to form a platform or support for the outer tube. The support, in certain examples may include a threaded portion for mating with internal threads of the outer tube 112. Alternative fastening means are contemplated for joining the core 102 to the outer tube 112.

Figure 4A:
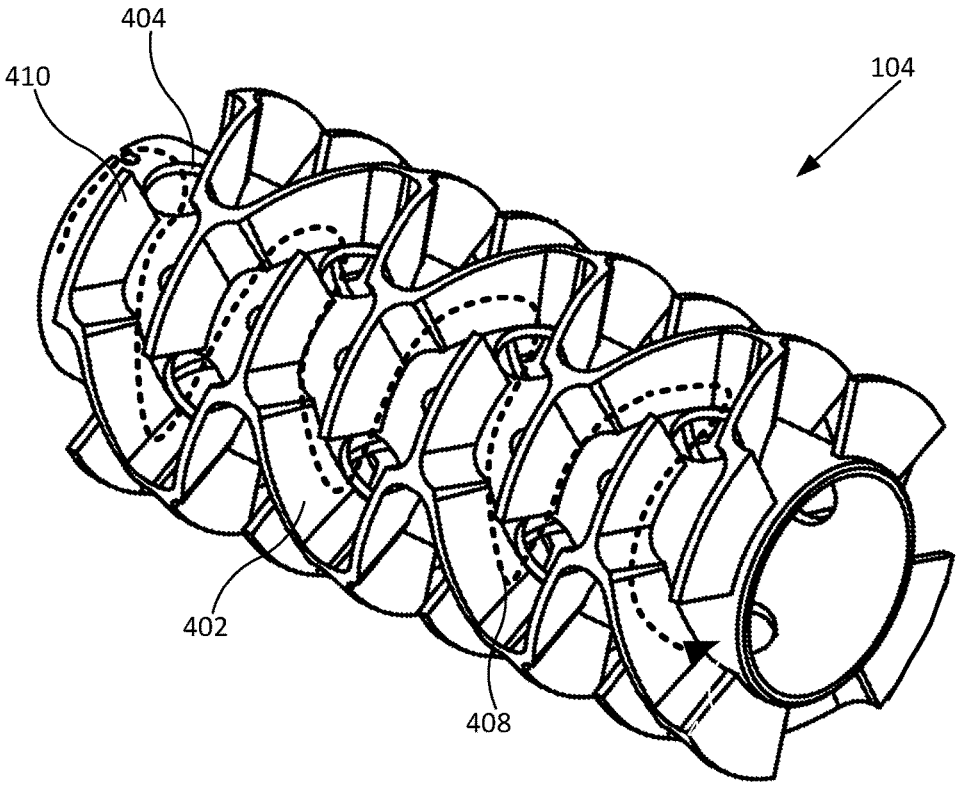
FIGS. 4*a* and 4*b* are schematic diagrams illustrating certain examples of the baffle sleeve in accordance with examples of the present disclosure.
Figure 4B:
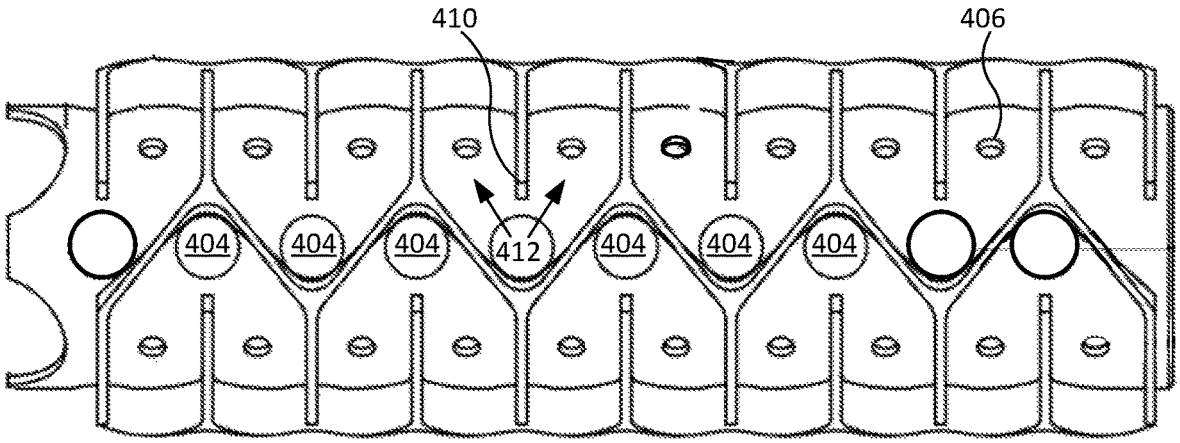

FIGS. 4*a* and 4*b* are schematic diagrams illustrating certain examples of the baffle sleeve 104 in accordance with examples of the present disclosure. FIG. 4*a* is a perspective view diagram and FIG. 4*b* is a side perspective view diagram. The baffle sleeve 104 is configured with an inner diameter that is selected to be larger than an outer diameter of the core 102 so that the core 102 is insertable into the baffle sleeve 104. The baffle sleeve 104, in one example, is formed with at least one uninterrupted fluid pathway extending in a generally longitudinal manner from one end of the baffle sleeve to another end. Stated differently, a fluid pathway is formed between baffles 402 (or ridges), the baffle sleeve 104, and the outer tube 112. Each fluid pathway may "snake" along the exterior of the baffle sleeve 104 between a series of baffles 402 from one end of the baffle sleeve 104 to the second end. As used herein, the phrase "uninterrupted fluid pathway" refers to a fluid pathway on the exterior surface of the baffle sleeve 104 that is not completely blocked by a baffle 402 or other wall. Accordingly, gasses that enter a first opening 404 adjacent a first end of the baffle sleeve 104 may proceed along the exterior surface of the baffle sleeve 104 to a second opening 406 adjacent the second end of the baffle sleeve 104, as depicted by dotted line 408. The first opening 404 may be aligned with a port 304.

In the depicted example, the baffles 402 on either side of the fluid pathway 408 extend inward in an interdigitated manner to create a zig-zag type pattern. The baffles 402, as depicted, may be formed in repeating and interdigitated geometric shapes such as partial hexagons (i.e., V or U-shaped baffles), or alternatively, may be formed in a more organic and/or random fashion, as long as the fluid pathway 408 is uninterrupted along the exterior surface of the baffle sleeve 104. In an alternative example, however, a baffle 402 may be placed in the fluid pathway 408 to direct fluid (i.e., gas) towards the core 102 from the exterior surface of the baffle sleeve 104. Two or more interdigitated fluid pathways may be formed on the exterior surface of the baffle sleeve 104. In an alternative example, a single fluid pathway may be formed that snakes back and forth across the exterior surface of the baffle sleeve. In other words, the fluid pathway 408 may be laterally serpentine along a longitudinal axis, with the turns of the fluid pathway 408 interdigitating with an adjacent fluid pathway. For example, the fluid primarily flows laterally (i.e., the fluid travels a greater distance from side to side, than longitudinally towards the end of the suppressor) along the exterior surface of the baffle sleeve.

Openings 406 formed in the fluid pathway 408 allow gas to flow between the core 102 and the outer chamber formed by the baffle sleeve 104 and outer tube (see FIG. 1). This prevents a buildup of pressure as the projectile/bullet passes through the core 102.

As the gasses exit the core 102 into the outer chamber formed by the baffle sleeve 104 and the outer tube, the shape of the baffles 402 redirects the gasses down at least one fluid pathway. In other examples, the baffles 402 redirect gasses into two or more directions in the same fluid pathway 408. As depicted in FIG. 4*b*, and as described above, gasses exiting a port in the core have formed a vortex due to the helical flutes. As the vortex spins into the outer chamber, a tip 410 of the baffle adjacent an opening 404 interrupts the vortex and causes gasses to flow in multiple directions as indicated by arrows 412. Thus, in certain examples, it is beneficial to have a tip 410 of a baffle disposed adjacent on opening that aligns with one of the ports 304.

Beneficially, as the bullet/projectile passes the next set of ports 304 in the core the venting gasses are directed up into the baffle sleeve and the interlocking box V pattern, for example, provides for sonic wave cancelation as the baffle 402 design and port 304 placement cause the pressure waves of alternating port openings to collide. This also accomplishes pressure equalization. In other words, the design of the interdigitated baffles causes adjacent port openings to exhaust gasses into different fluid pathways. Every other port opening 404 exhausts into the same fluid pathway, as depicted. Alternatively, a design may be contemplated that exhausts adjacent, or every third, for example, port into the same fluid pathway.

Ports 404 in the baffle sleeve are positioned to coordinate (or align with) the ports 304 in the core. Additional openings, which may be smaller, allow gasses to expand into the troughs. The sequencing of the expansion ports creates a rearward flow of gasses in the troughs and cutouts in the baffle sleeve 104 allow those gasses to flow back up into the baffle sleeve. As pressures equalizes gasses can flow back into the core 102 through the helical fluting 312, further cooling and slowing the gasses. Furthermore, the symmetrical design of the four intersecting ports 304 creates additional wave cancelation. The baffle sleeve 104 also provides slowing, cooling, and expansion of the gasses.

Figure 5:
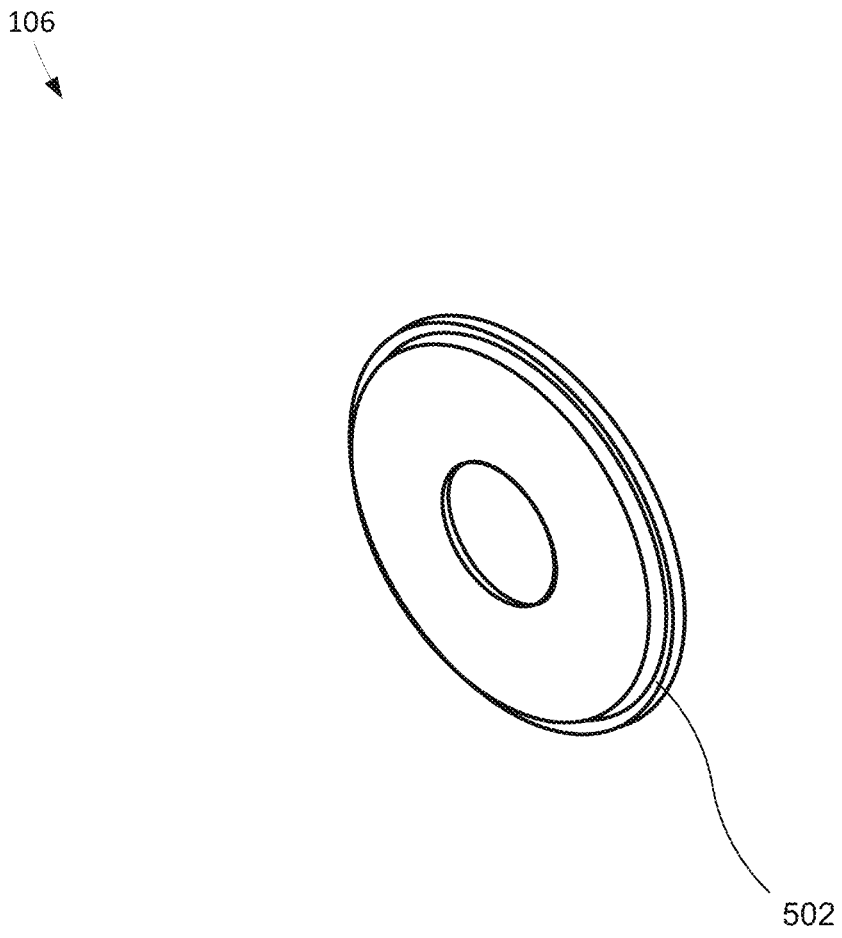
FIG. 5 is a perspective view diagram illustrating one example of the baffle tube retainer in accordance with examples of the present disclosure.

FIG. 5 is a perspective view diagram illustrating one example of the baffle tube retainer 106 in accordance with examples of the present disclosure. In the example as depicted in FIG. 1, the baffle tube retainer 106 is configured to retain the baffle sleeve 104. The baffle tube retainer 106 is configured with a lip 502 that is sized to engage the inner diameter of the baffle sleeve 104. The spacer tube 108, as will be described below in greater detail, threads into the core 102. The baffle tube retainer 106 is disposed between the spacer tube 108 and the baffle sleeve 104, and accordingly maintains the position of the baffle sleeve 104 with respect to the core 102. In one example, the baffle tube retainer 106 is a machined washer with alignment tabs that locate with the baffle sleeve 104 and the outer tube 112.

Figure 6:
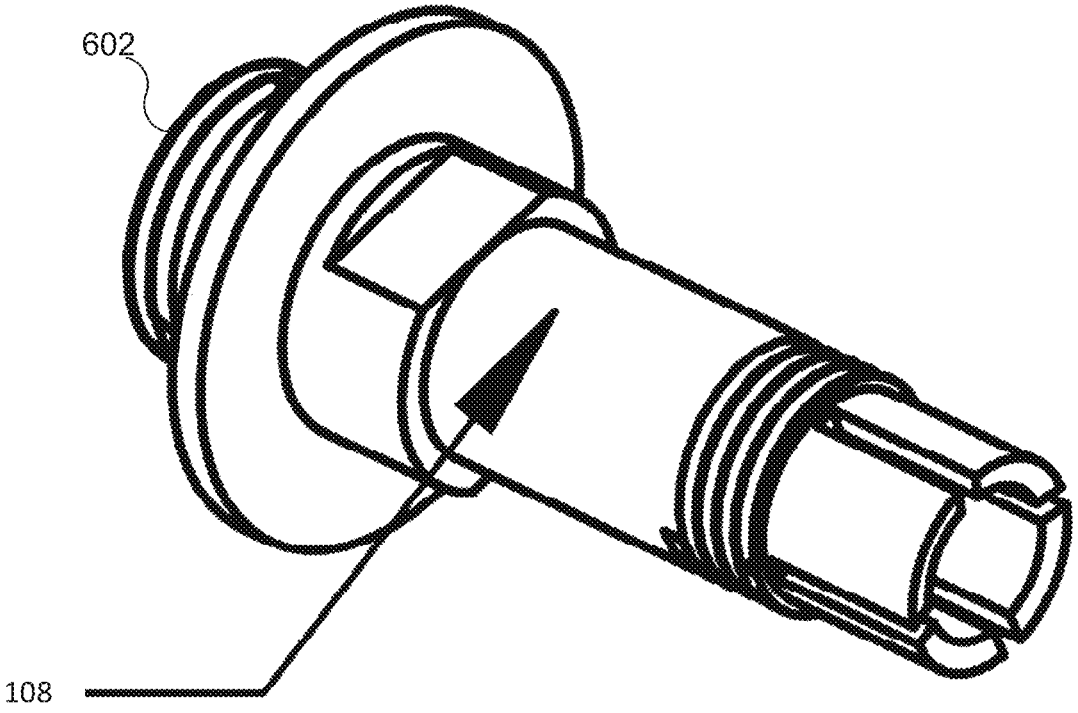
FIG. 6 is a perspective view diagram illustrating one example of the spacer tube in accordance with examples of the present disclosure.

FIG. 6 is a perspective view diagram illustrating one example of the spacer tube 108 in accordance with examples of the present disclosure. The spacer tube 108, in one example has a threaded end 602 for attaching the spacer tube 108 to the core 102. Alternatively, other methods of fastening the spacer tube 108 to the core 102 are contemplated, including but not limited to, standard quick-disconnect systems, or permanently fastened bondings. In some examples, the opposite end includes cut out areas (i.e., "prongs") for further venting of gasses beyond the core 102. Additionally, the prongs create a flash hider/flash diffuser, should any unburned gasses or ignited oxygen pass out of the suppressor bore.

In one example, the spacer tube 108 has a substantially solid outer surface. Unlike many of the other components of the present disclosure, the spacer tube 108 is solid to prevent gasses from passing from the interior channel to the outer tube or baffle sleeve. In this manner, the spacer tube 108 functions as a final alignment tube, and prevents gasses/shockwaves from affecting the direction and accuracy of the bullet. For the brief time that a bullet is in the spacer tube 108, the spacer tube 108 acts as a plug for the suppressor 100 and forces gasses to exit the suppressor 100 through the forward baffles 110 instead of through the bore of the spacer tube 108.

Figure 7:
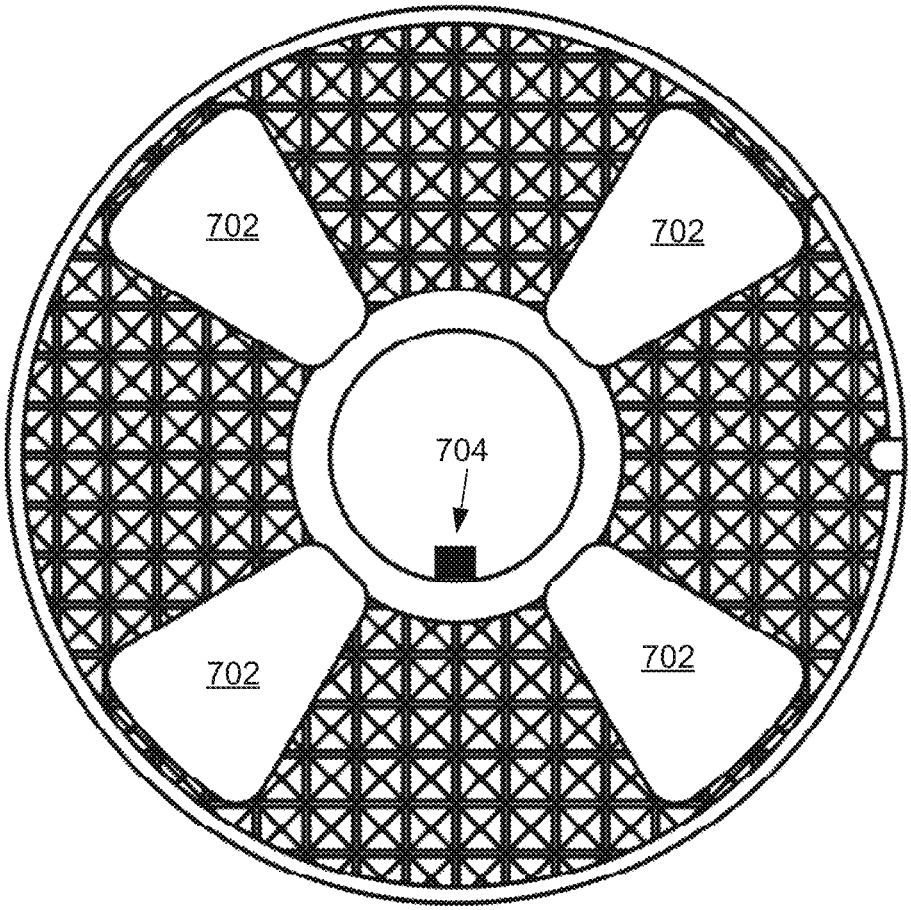
FIG. 7 is a perspective view diagram illustrating one example of one of the forward baffles in accordance with examples of the present disclosure.
Figure 8A:
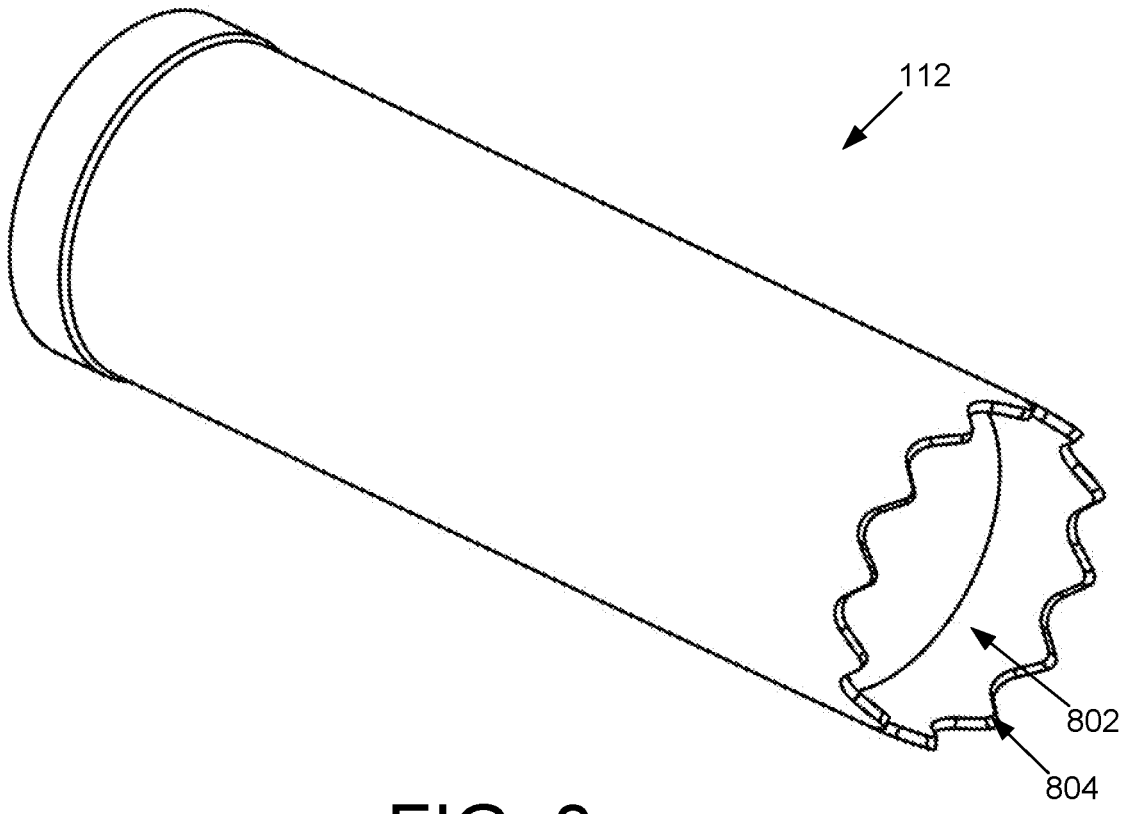
FIGS. 8*a*, 8*b*, 9*a*, and 9*b* are diagrams illustrating different examples of the outer tube.
Figure 8B:
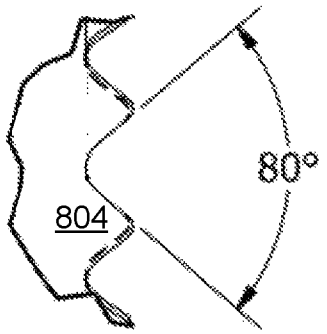

FIG. 7 is a perspective view diagram illustrating one example of one of the forward baffles 110 in accordance with examples of the present disclosure. In one example, the forward baffles 110 resemble a disk. The outer chamber (formed by the baffle sleeve and the core) releases its gasses primarily through a series of four interlocking, offset forward baffles 110. Each forward baffle 110 may be formed with one or more elliptical ports. In a further example, each forward baffle includes four evenly spaced elliptical ports 702, though other shapes or numbers of elliptical ports may also be used. Stated differently, any equally spaced, and radially extending opening may be used. In the depicted example, the openings/ports are positioned with a 90-degree separation from an adjacent port. If, for example, the number of openings increased or decreased, the angle of separation may also correspondingly increase or decrease.

Beneficially, by spacing the baffles 110 closer together or further apart, in conjunction with the port sizes and shapes, the pressure at which the gasses begin to exit the outside chamber, and the velocity at which the suppressor vents, can be regulated. In this implementation, the baffles 110 are offset one quarter rotation (i.e., 90 degrees) forcing the gasses to make one full rotation prior to exiting the outer tube of the suppressor, because there are 4 baffles. Each forward baffle 110 may incorporate a non-planar surface or irregular surface, such as the depicted diamond pattern, to cause turbulence in the gas flow, and thereby further slowdown the gas flow. Additionally, the diamond pattern helps extinguish a flash or flame and helps slow and cool the gasses. In one example, the series of forward baffles 110 are disposed on the spacer tube 108 and extend outward to the outer tube. The forward baffles 110 may include a key 704 to engage a slot in the spacer tube 108 to maintain proper alignment, or alternatively, the forward baffles 110 may be friction fixed into position (or interference fit) within the outer tube.

FIGS. 8*a*, 8*b*, 9*a*, and 9*b* are diagrams illustrating different examples of the outer tube 112. The outer tube 112, in one example, threads onto a raised portion (e.g., base 320) of the core 102 disposed adjacent the inlet end (i.e., nearest the rifle) of the suppressor. The outer tube 112 encircles all of the above-described components to form a protective shield, and to form part of the outer chamber and/or fluid pathways.

In the depicted example, the outer tube 112 is tubular, but other implementations can be envisioned where a different interior or exterior shape are used, such as cooling flutes or fins applied to the exterior surface to enhance cooling and reduce thermal signatures. Alternatively, the outer tube 112 may be, for example, hexagonal. The outer tube 112 may be formed with a ledge or ridge 802 which holds the forward baffles 110 on the pressure tube 108. The ridge 802 may be annular and positioned adjacent the muzzle end of the outer tube 112, as depicted. This implementation of the outer tube 112 extends beyond the last baffle 110 and pressure tube to create a recessed space at the end of the suppressor where the gasses exit. Alternatively, the outer tube 112 may be formed with a groove for receiving, for example, a lock washer that operates in a manner similar to the ledge or ridge 802.

The exit end of the outer tube may incorporate teeth 804 or "chevrons." In the depicted example there are twelve evenly spaced teeth 804. These provide several benefits, first as the hot gasses exit the outer chamber and suppressor bore and begin to expand into the outside ambient air, which creates a sonic signature, the teeth 804 break up and diffuse the gas's expansion which reduces the sonic signature. The teeth 804 are also useful to diffuse and reduce any muzzle flash which may exit the suppressor.

Figure 9A:
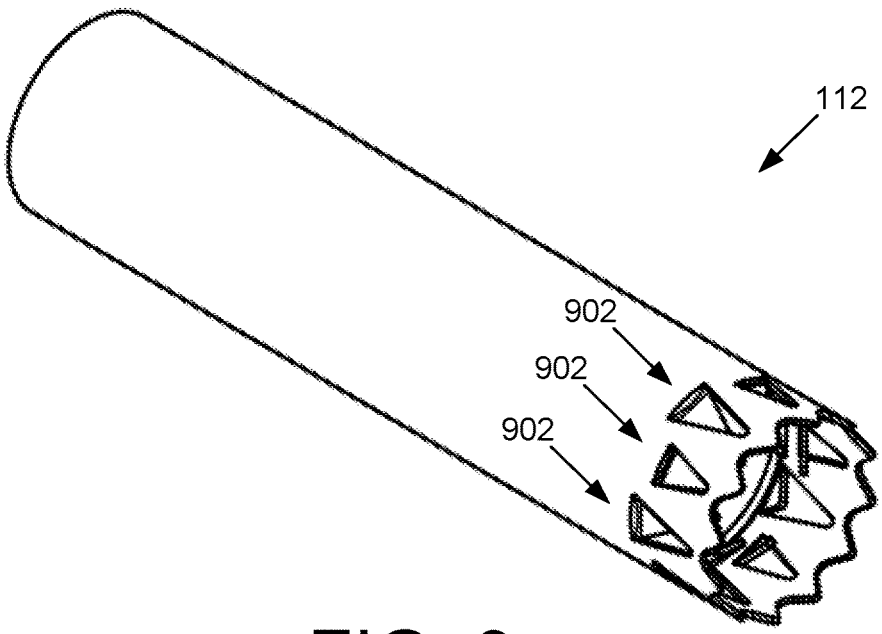
Figure 9B:
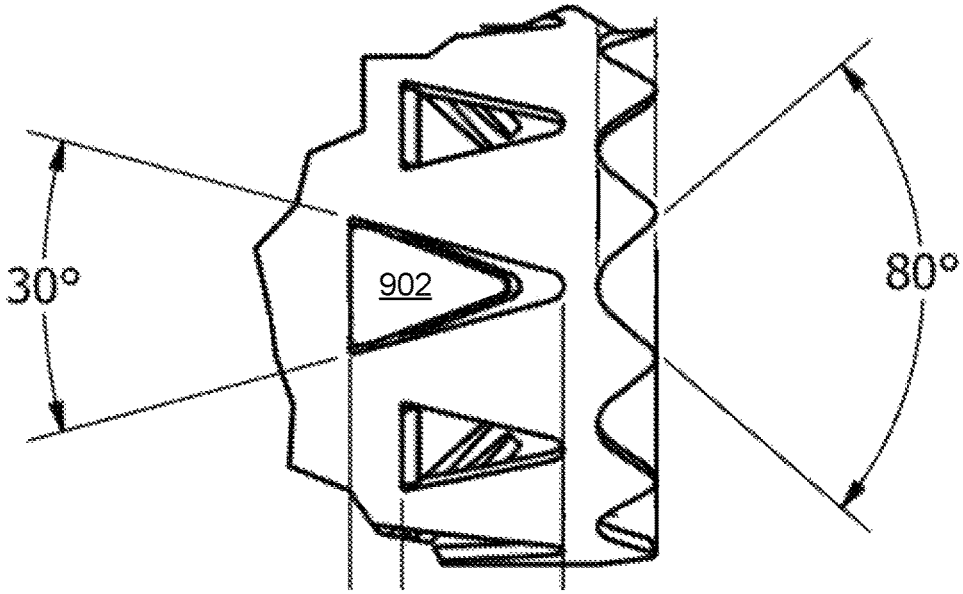

In one example, the outer tube 112 may also incorporate venturi diffuser tabs 902 (see FIGS. 9*a* and 9*b*). These venturi tabs 902, in one example, are elongated and triangular in shape, and disposed adjacent the end of the outer tube 112. In a further example, the venturi tabs 902 are evenly spaced around the outer tube 112, and may be formed with alternating larger and smaller venturi tabs 902, as depicted. The tabs may be formed by pressing or punching the triangular shape into the recessed space at the end of the suppressor. As the hot gasses exit the suppressor, through either the outer chamber or bore, pass the venturi tabs 902 the gasses are forced to flow around the triangular shaped tabs, which create greater flow disruption, thereby slowing and diffusing the gasses and disrupting the sonic signature of both the supersonic airflow ahead of the bullet/projectile, and the expanding hot muzzle gasses from the burned propellants. As the hot gasses flow past the venture tabs 902, cooler ambient air is pulled into the recessed end of the suppressor mixing with the hot gasses, cooling and slowing their expansion rate and sonic signature.

Figure 10:
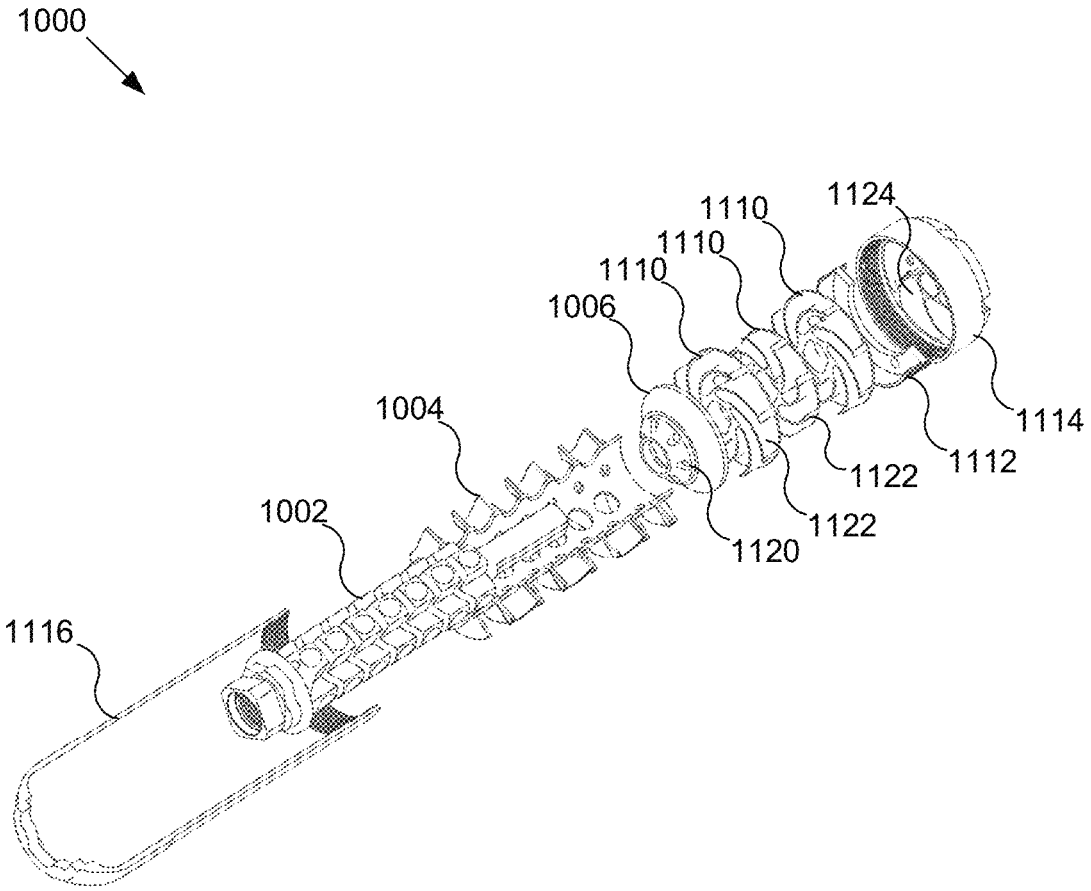
FIG. 10 is an exploded perspective view diagram illustrating one example of a firearm suppressor in accordance with examples of the present disclosure.

FIG. 10 is an exploded perspective view diagram illustrating one example of a firearm suppressor 1000 in accordance with examples of the present disclosure. Although the below described examples describe the use of the suppressor 1000 in use with a rifle, the components and methods described may be modified to accommodate different types of firearms, including but not limited to, pistols, shotguns, etc.

In the depicted example, the suppressor 1000 is formed of multiple individual components that may be separately manufactured and assembled to form the suppressor 1000. However, the suppressor 1000 may alternatively be manufactured as a single unitary product. It is contemplated that as 3D printing techniques improve, the suppressor 1000 may be manufactured by these 3D printing techniques. Generally, the suppressor 1000 is formed of metals and/or metallic alloys. Different materials may be used for the different components, as it may be desirable for one component to absorb and diffuse heat, and thereby have a high coefficient of thermal conductivity, and another component to have a low coefficient of thermal conductivity.

As depicted, the suppressor 1000 is formed with a core 1002, a baffle sleeve 1004, a baffle tube retainer 1006, one or more forward baffles 1110, a baffle retainer 1112, an end cap 1114, and an outer tube. The suppressor 1000 has a longitudinal axis that extends from a longitudinal axis of a firearm barrel 116, and depicts the path a bullet will travel from the barrel 116 towards the exit of the suppressor 1000. The suppressor 1000 is formed with an inlet that engages the muzzle end of the barrel 116 to receive a bullet, or other high energy (i.e., high velocity) device, and an outlet through which the bullet travels and for exhausting and dissipating muzzle blast, bullet shock waves, and other particulates.

The core 1002 will be described in greater detail below. The baffle sleeve 1004 functions in a manner similar to the baffle sleeve 104 described above with reference to FIGS. 1-9. The outer tube 1116 surrounds the components, some of which make contact with an inner surface of the outer tube 1116. For example, the baffle tube retainer 1006 is sized to make contact with the outer tube 1116 so that exhaust gasses that are traveling towards the end cap 1114 are forced to travel through passages 1120 in the baffle tube retainer 1006. This effectively slows down the exhaust gasses. The baffle tube retainer 1006 may include a chamfered surface for locating the baffle tube retainer 1006 within the baffle sleeve 1004. In certain examples, the baffle tube retainer 1006 includes an extended portion configured to insert into the baffle sleeve. A stem of the core 1002 extends through and locates the baffle tube retainer 1006 and the forward baffles 1110.

Positioned adjacent the baffle tube retainer 1006 are the one or more forward baffles 1110. The forward baffles 1110, in certain examples, alternate from clockwise vanes 1122 to counterclockwise vanes 1122, or vice-versa. Each of the forward baffles 1110 serves to either "spin" exhaust gasses outward or inward. If outward, the exhaust gasses are slowed and rotated outward to a gap between a perimeter of the forward baffle 1110 and the outer tube 1116. The gasses then pass to a forward baffle 1110 that makes contact with the outer tube 1116 and forces the exhaust gasses to "spin" inward. Each forward baffle 1110 serves to slow down the exhaust gasses. Any suitable number of forward baffles 1110 may be used.

In certain examples, the baffle retainer 1112 is configured with threads on an exterior surface that correspond with threads on an interior surface of the outer tube 1116. The threads also function to secure the end cap 1114 to the outer tube 1116. The baffle retainer 1112 functions as a threaded joint to couple the outer tube 1116 to the end cap 1114. Other mechanisms are contemplated for coupling the end cap 1114 to the outer tube 1116. The end cap 1114, in certain examples, is configured with exit vanes 1124 that are configured to further spin the exhaust gasses as the exhaust gasses leave the suppressor. For example, the exit vanes 1124 may resemble fan blades of the blades of a propeller.

Figure 11A:
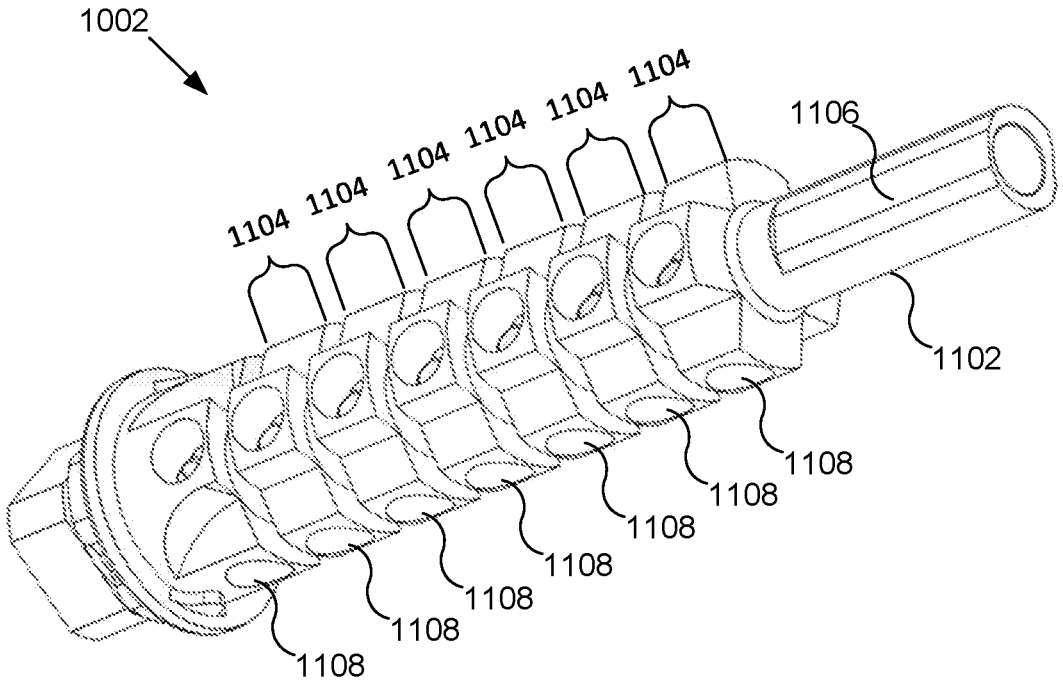
FIGS. 11*a* and 11*b* are diagrams illustrating different views of the core, in accordance with examples of the subject disclosure.
Figure 11B:
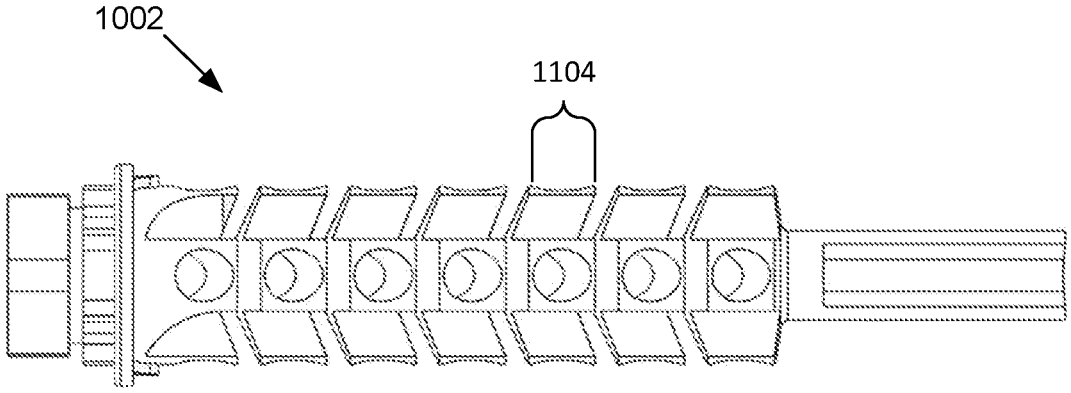

FIGS. 11*a* and 11*b* are diagrams illustrating different views of the core 1002, in accordance with examples of the subject disclosure. The core 1002, as described above with reference to the core 102 of FIG. 2, may be a single component that may be machined or cast from appropriate materials, including, but not limited to steel, stainless steel, titanium, Inconel and aluminum. In one example, the core 1002 threads onto the muzzle of the firearm (i.e., the end of the barrel 116 of FIG. 1) with various types of standard or metric threads.

In certain examples, the core 1002 includes the stem 1102 extending outward from a plurality of adjacent exhaust blocks 1104. The stem 1102 may have an index slot 1106 for rotationally indexing the baffle retainer and forward baffles.

The core 1002 may have a series of ports 1108 within each exhaust block 1104 that extend radially outward from the bore. In the below description, a port is generally identified as "port 1108," and may be individually identified as "port 1108*a*," etc. Each port 1108 forms a channel that fluidly couples an interior surface of the core 1002 with an exterior surface. Stated differently, each port 1108 creates an opening that extends from the exterior surface to the interior surface. The core 1002 may be formed with the segmented exhaust blocks 1104 to reduce weight and increase surface area for cooling exhaust gasses. As depicted in FIG. 11*b*, the exhaust blocks 1104 may be angled forward to correspond with the forward angle of the ports 1108.

Figure 12:
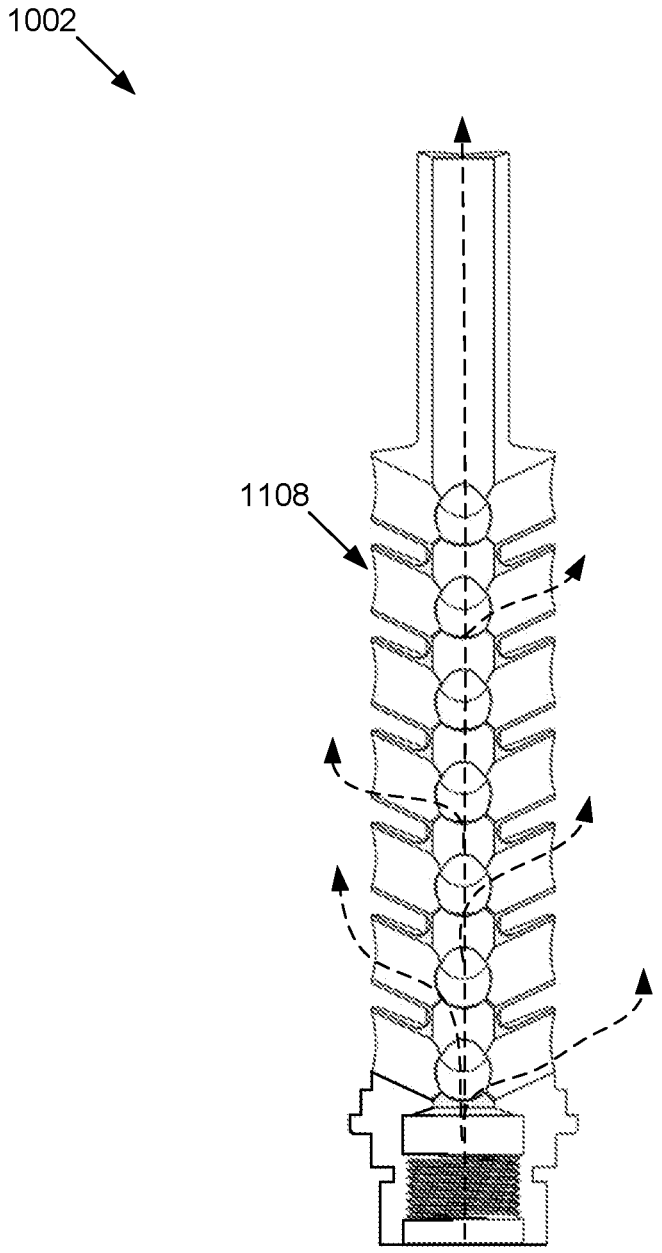
FIGS. 12 and 13 are diagrams illustrating cross-sectional views of the core, according to examples of the subject disclosure.
Figure 13:
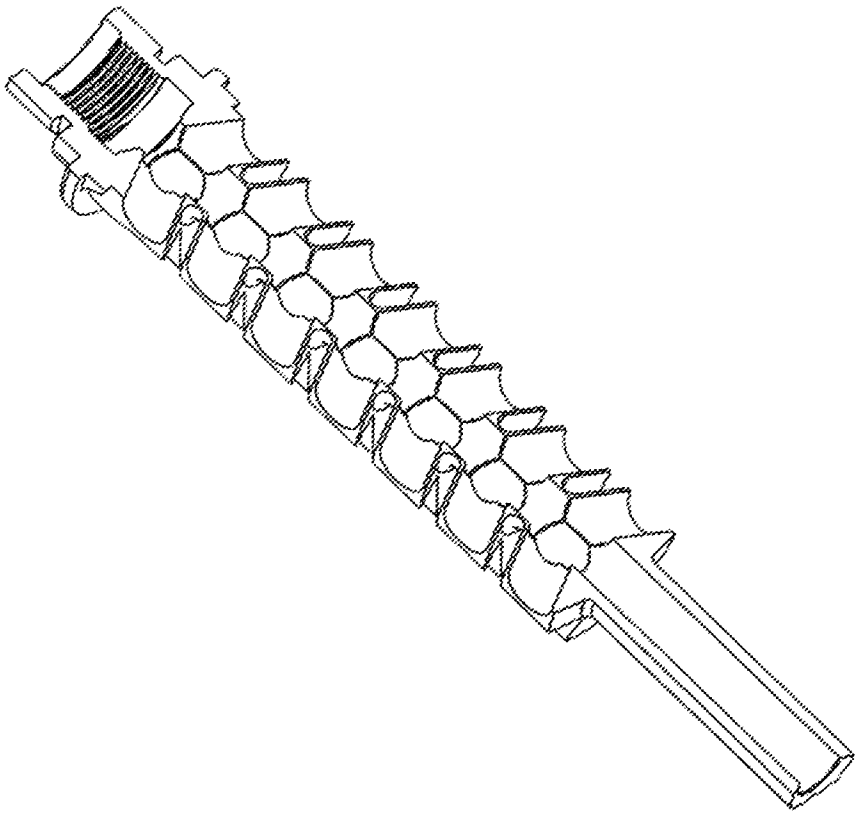

FIGS. 12 and 13 are diagrams illustrating cross-sectional views of the core 1002, according to examples of the subject disclosure. In the depicted embodiment of FIG. 12, dotted lines depict only a portion of exhaust gas flow. It is intended that each port 1108 will have exhaust gasses flowing therethrough, but for the purpose of clarity, the majority of the exhaust gas flow lines are omitted here.

In the depicted examples, the ports 1108 are generally arranged in a longitudinal manner, or in other words, a series of ports 1108 are linearly aligned. In one example, each series of linearly arranged ports is spaced 90 degrees from the neighboring series of ports. Stated differently, if one were to look down the bore along the longitudinal axis, the ports 1108 would extend along the 12, 3, 6, and 9 o'clock positions as depicted in FIG. 3*b*. Other arrangements are contemplated, including, but not limited to more or less series of ports 1108, non-linearly arranged series (e.g., a series aligned with a path that extends helically around the exterior of the core 102), randomly positioned ports, etc.

Referring to FIG. 13, which is a cross-sectional diagram of the core 1002, the ports may be angled forward (i.e., towards the muzzle end 120 of the suppressor) to create a forward moving air flow. In other words, the ports 1108 extend outward from the bore at a non-orthogonal angle with respect to the bore. In other examples, the ports extend perpendicularly from the bore, or alternatively, the ports may be angled rearward (i.e., towards the muzzle end of the rifle). As used herein, the phrase "muzzle end" refers to the opening through which a bullet exits a device.

The monolithic nature of the core 1002, beneficially, has no initial blast baffle (as in most suppressors) and therefore eliminates issues with higher pressure cartridges, and virtually eliminates backpressure. As used herein, the term "monolithic" refers to the method of manufacture of the core 1002, in that the core 1002 is formed from a single block of material. Further, the monolithic core 1002 provides greater strength, rigidity and no possibility of a baffle strike by the bullet/projectile caused by baffle misalignment. Baffle erosion is also eliminated.

The benefits of the above-described firearm suppressor are many, and include sonic signature reduction. The firearm suppressor of the current disclosure reduces the sound signature from firearms resulting from the discharge of the cartridges and the exiting of high pressure, high velocity, hot expanding gasses from the firearms muzzle which displaces ambient air and creates sound signatures typically between 160 and 170 decibels. The firearm suppressor of present disclosure provides a three-dimensional gas flow and opens up the full internal volume of the suppressor for gas expansion and diffusion. The firearm suppressor also acts as a very effective heat sync to transfer heat from the gasses to the suppressor over the entire length.

The benefits also include muzzle flash and first round flash suppression. The current suppressor design effectively extinguishes the flame from the burning gun powder or propellant by creating a high degree of flow turbulence. The design also facilitates the purging of ambient air and oxygen contained in the suppressor by bleeding off the pressure wave that travels ahead of the bullet, which creates a vacuum and the expanding gasses filling that vacuum. The firearm suppressor also has flame/flash extinguishing properties incorporated into the forward shredder baffles, pressure tubes and outer tube.

The benefits also include reduced back pressure. When used in conjunction with semi-automatic and fully automatic firearms, back pressure causes a number of negative effects, such as increased cyclic rate, blow back of carbon, debris and hot gasses into the operating system, action and face of the shooter, which system reliability. The firearm suppressor of the current disclosure has a unique three-dimensional design that allows for symmetrical gas flow. The lack of a blast baffle and primary chamber just ahead of the muzzle means that these is no stored pressure. Gasses are flowed outward away from the suppressor bore to an outer chamber that also does not trap the gas pressure, but rather, allows it to expand in the outer chamber, which incorporates a pressure release mechanism through the shredder baffles, and lowers and equalizes pressures.

The benefits also include thermal signature and thermal failure reduction. The design facilitates the even transfer of heat across the entire suppressor and all components and rapid cooling after firing. This prevents hot spots from occurring which create a greater thermal signature that can give away a soldier or officers position. Also, thermal related failures are the number one cause of suppressor structural failures.

The benefits also include weight reduction. Because the firearm suppressor of the current disclosure does not have a blast baffle and store large amounts of pressure the suppressor is cartridge agnostic and could be used with virtually any cartridge in that caliber. Additionally, because heat, excess pressure and high velocity flow of the gasses out of the primary chamber through the small-bore hole is not an issue with this design, lighter materials such as titanium can be used for the monolithic core, and other components.

The benefits also include accuracy. The turbulence created by the baffle-chamber design of other common suppressors can have negative effects on accuracy, depending on the shape and configuration of those baffles and chambers. As bullets pass through the baffles of the common suppressors and into ambient air chambers a sonic boom is created in the chamber. Depending upon how the sonic waves are reflected in those chambers, bullet flight can be disrupted. Additionally, as the hot gasses expand and reflect in the chambers of common suppressors while the bullet is in the chamber, accuracy robbing turbulence can be created. Lastly, as the hot gasses expand in each chamber of the common suppressor, they are then squeezed out a small hole in the suppressors bore, which may accelerate gasses against the base of the bullet, which in turn can also negatively affect accuracy. The firearm suppressor of the current disclosure pulls gasses outward from the bore of the firearm suppressor and away from the base of the bullet. Additionally, the firearm suppressor minimizes the locations where a sonic boom can occur and therefore turbulence in the bore is not created. In addition, the sonic wave that travels ahead of the bullet is bled off and disrupted by the angled symmetrical ports, which reduces both sonic signature and turbulence from supersonic air movement through the bore.

The benefits also include improved water displacement. The firearm suppressor of the current disclosure allows a firearm to be fired with water in the system as the air/gas flow displaces the water, forcing it out of the firearm suppressor, without creating an over-pressure situation that could cause a catastrophic failure. Also, when held pointed down, the current suppressor will drain rapidly in a matter of seconds.

The core 1002 of FIGS. 10-13 is a single component that may be machined or cast from appropriate materials, including, but not limited to steel, stainless steel, titanium, Inconel and aluminum. In one example, the core 102 threads onto the muzzle of the firearm (i.e., the end of the barrel 116 of FIG. 1) with various types of standard or metric threads. Additionally, as depicted in FIG. 2, the opposite end of the core 102 may have internal threads for receiving a male threaded end of the spacer tube 108.

In one example, interrupted threads (not shown) may be utilized to implement a quick attachment method to attach the core 1002 over a muzzle device such as a flash hider, muzzle brake, or muzzle signature management device. In another example, the core 1002 may have flats machined or otherwise formed on the muzzle-engaging end to allow a wrench, or other tool, to apply torque to the suppressor 100 to attach it to the firearm.

The core 1002 may have a series of ports that extend radially outward from the bore. Each port forms a channel that fluidly couples an interior surface of the core 1002 with an exterior surface. Stated differently, each port creates an opening that extends from the exterior surface to the interior surface.

As depicted, the exterior surface of the core 1002 may be machined down to reduce weight, increase surface area, and create a virtual outer chamber. The core 1002 may be formed with annular channels disposed between pairs of adjacent exhaust blocks. The annular channels may extend from the outer surface of the core 1002 to an area adjacent the bore at an angle. Alternatively, the annular channels may extend perpendicularly to the bore.

Reference throughout this specification to features, advantages, or similar language does not imply that all of the features and advantages that may be realized with the subject matter of the present disclosure should be or are in any single example. Rather, language referring to the features and advantages is understood to mean that a specific feature, advantage, or characteristic described in connection with an example is included in at least one example of the present disclosure. Thus, discussion of the features and advantages, and similar language, throughout this specification may, but do not necessarily, refer to the same example.

Furthermore, the described features, advantages, and characteristics of the subject matter of the present disclosure may be combined in any suitable manner in one or more examples. One skilled in the relevant art will recognize that the subject matter may be practiced without one or more of the specific features or advantages of a particular example. In other instances, additional features and advantages may be recognized in certain examples that may not be present in all examples. These features and advantages will become more fully apparent from the following description and appended claims, or may be learned by the practice of the subject matter as set forth hereinafter.

Reference throughout this specification to "one example," "an example," or similar language means that a particular feature, structure, or characteristic described in connection with the example is included in at least one example of the present invention. Thus, appearances of the phrases "in one example," "in an example," and similar language throughout this specification may, but do not necessarily, all refer to the same example.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present invention may be embodied in other specific forms without departing from its spirit or essential characteristics. The described examples are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A firearm suppressor comprising:

an elongated core comprising at least one series of ports extending radially from a bore to an exterior surface of the core, where the at least one series of ports is disposed linearly along a longitudinal axis of the core, and where the elongated core comprises at least one annular channel that circumscribes the elongated core and is formed in the exterior surface of the core and disposed between adjacent pairs of the ports;

a baffle sleeve disposed around the core, the baffle sleeve having at least one uninterrupted fluid pathway extending along the exterior surface of the baffle sleeve and formed by interdigitated baffle ridges; and an outer tube disposed around the baffle sleeve.

2. The firearm suppressor of claim 1, where the at least one series of ports extending radially from the bore comprises two series of ports extending radially from the bore.

3. The firearm suppressor of claim 1, where each port of the at least one series of ports extends outward radially from the bore at a non-orthogonal angle.

4. The firearm suppressor of claim 3, where each port of the at least one series of ports is angled toward a muzzle end of the elongated core.

5. The firearm suppressor of claim 4, where the non-orthogonal angle is in a range of between about 5 and 80 degrees.

6. The firearm suppressor of claim 1, where the baffle sleeve further comprises a plurality of port openings that fluidly couple an interior surface of the baffle sleeve with an exterior surface of the baffle sleeve, and where at least one of the plurality of port openings is positioned such that the at least one of the plurality of port openings is aligned with at least one port of the at least one series of ports.

7. The firearm suppressor of claim 1, where the elongated core comprises a stem extending outward from an exhaust block.

8. The firearm suppressor of claim 7, where the stem is configured to receive a baffle sleeve retainer and a plurality of forward baffles.

9. The firearm suppressor of claim 8, where the baffle sleeve retainer comprises a plurality of annularly arranged passages.

10. The firearm suppressor of claim 8, where each of the plurality of forward baffles comprises at least one vane configured to direct exhaust gasses in either one of a clockwise direction or a counterclockwise direction.

11. The firearm suppressor of claim 8, further comprising a forward baffle retainer comprising a threaded outer surface configured to thread into an end of the outer tube.

12. The firearm suppressor of claim 11, further comprising an end cap configured to couple to the forward baffle retainer.

13. The firearm suppressor of claim 12, where the end cap comprises at least one direction vane configured to rotationally direct exhaust gasses as the exhaust gasses leave the firearm suppressor.

14. The firearm suppressor of claim 8, where each of the forward baffles comprises a key in an opening that is configured to engage an indexing slot in the stem to rotationally index each of the forward baffles with respect to the elongated core.

15. The firearm suppressor of claim 1, where the elongated core further comprises a base having a diameter greater than the elongated core, where the base forms a platform for receiving the baffle sleeve and the outer tube.

16. A core of a firearm suppressor, the core comprising:

at least one series of ports extending radially from a bore to an exterior surface of the core, where the at least one series of ports is disposed linearly along a longitudinal axis of the core, and where the core comprises at least one annular channel that circumscribes the core and is formed in the exterior surface of the core and disposed between adjacent pairs of the ports; and a stem extending outward from an exhaust block, where the stem is configured to receive a baffle sleeve retainer.

17. The core of claim 16, where the stem is configured to receive a plurality of forward baffles.

18. The core of claim 17, where each of the plurality of forward baffles comprises at least one vane configured to direct exhaust gasses in either one of a clockwise direction or a counterclockwise direction.

19. The core of claim 16, where the core is further configured with a base, where the base is configured to support a baffle sleeve.

20. A baffle sleeve of a firearm suppressor having a core with a plurality of radially extending ports and at least one annular channel that circumscribes the elongated core and is formed between adjacent pairs of the plurality of radially extending ports, the baffle sleeve comprising:

a plurality of uninterrupted fluid pathways formed on an exterior surface of the baffle sleeve and extending from a first end of the baffle sleeve to a second end of the baffle sleeve, where each of the plurality of uninterrupted fluid pathways is defined by a plurality of interdigitated baffle ridges, where the plurality of interdigitated baffle ridges of each of the plurality of uninterrupted fluid pathways defines a laterally serpentine pathway along a longitudinal axis.

* * * * *